US006994770B2

(12) United States Patent
Shannon et al.

(10) Patent No.: US 6,994,770 B2
(45) **Date of Patent: *Feb. 7, 2006**

(54) STRENGTH ADDITIVES FOR TISSUE PRODUCTS

(75) Inventors: Thomas G. Shannon, Neenah, WI (US); Dave Allen Soerens, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 227 days.

This patent is subject to a terminal disclaimer.

(21) Appl. No.: 10/325,668

(22) Filed: Dec. 20, 2002

(65) Prior Publication Data

US 2004/0118541 A1 Jun. 24, 2004

(51) Int. Cl.
*D21H 21/20* (2006.01)

(52) U.S. Cl. ..... 162/168.1; 162/168.3; 162/135; 162/109; 162/158; 162/179; 424/402; 428/413

(58) Field of Classification Search ..... 162/109, 162/158, 164.1, 168.1–168.3, 183, 184, 179, 162/135; 428/413, 537.5; 424/400, 402
See application file for complete search history.

(56) References Cited

U.S. PATENT DOCUMENTS 3,078,849 A 2/1963 Morse
3,556,932 A 1/1971 Coscia et al.
3,556,933 A 1/1971 Williams et al.
3,585,104 A 6/1971 Kleinert
3,700,623 A 10/1972 Keim
3,772,076 A 11/1973 Keim
3,855,158 A 12/1974 Petrovich et al.
3,899,388 A 8/1975 Petrovich et al.
4,028,172 A * 6/1977 Mazzarella ..... 162/164.4
4,100,324 A 7/1978 Anderson et al.
4,129,528 A 12/1978 Petrovich et al.
4,147,586 A 4/1979 Petrovich et al.
4,158,594 A 6/1979 Becker et al.
4,208,459 A 6/1980 Becker et al.
4,222,921 A 9/1980 Van Eenam
4,353,981 A * 10/1982 Noda et al. ..... 430/536
4,459,317 A 7/1984 Lambert
4,501,641 A 2/1985 Hirakawa et al.
4,514,345 A 4/1985 Johnson et al.
4,528,239 A 7/1985 Trokhan
4,589,873 A 5/1986 Schwartz et al.
4,594,130 A 6/1986 Chang et al.
4,604,313 A 8/1986 McFarland
4,642,257 A 2/1987 Chase
4,666,437 A 5/1987 Lambert
4,775,725 A 10/1988 DePasquale et al.
4,793,898 A 12/1988 Laamanen et al.
4,835,211 A 5/1989 Noda et al.
4,846,932 A 7/1989 Karita et al.
4,856,502 A 8/1989 Ersfeld et al.
4,902,553 A 2/1990 Hwang et al.
4,919,828 A 4/1990 Childers
4,943,460 A 7/1990 Markle et al.
4,959,125 A 9/1990 Spendel
4,973,680 A 11/1990 Billmers
5,004,791 A 4/1991 Billmers
5,049,235 A 9/1991 Barcus et al.
5,098,522 A 3/1992 Smurkoski et al.
5,135,516 A 8/1992 Sahatjian et al.
5,160,789 A 11/1992 Barcus et al.
5,173,208 A * 12/1992 Chung et al. ..... 252/180
5,224,714 A 7/1993 Kimura et al.
5,260,171 A 11/1993 Smurkoski et al.
5,262,007 A 11/1993 Phan et al.
5,264,082 A 11/1993 Phan et al.
5,275,700 A 1/1994 Trokhan
5,279,767 A 1/1994 Phan et al.
5,298,335 A 3/1994 Reed et al.
5,300,192 A 4/1994 Hansen et al.
5,312,522 A 5/1994 Van Phan et al.
5,328,565 A 7/1994 Rasch et al.
5,334,289 A 8/1994 Trokhan et al.
5,350,624 A 9/1994 Georger et al.
5,352,515 A 10/1994 Jarrett et al.
5,354,829 A 10/1994 Swisher et al.
5,360,419 A 11/1994 Chen et al.
5,427,696 A 6/1995 Phan et al.
5,431,786 A 7/1995 Rasch et al.
5,442,016 A 8/1995 Jarrett et al.
5,443,899 A 8/1995 Barcus et al.
5,496,624 A 3/1996 Stelljes, Jr. et al.
5,500,277 A 3/1996 Trokhan et al.
5,503,714 A 4/1996 Reiners et al.
5,514,523 A 5/1996 Trokhan et al.
5,554,467 A 9/1996 Trokhan et al.

(Continued)

FOREIGN PATENT DOCUMENTS

DE 19537088 A1 4/1997

(Continued)

OTHER PUBLICATIONS

PCT Search Report for PCt/US03/34899, Jun. 15, 2004.

(Continued)

*Primary Examiner*—José A. Fertuna
(74) *Attorney, Agent, or Firm*—Dority & Manning, P.A.

(57) ABSTRACT

A paper product having improved strength properties as disclosed. In accordance with the present invention, the paper product is treated with a strength agent comprising a derivatized polyethylene oxide. The paper product can be, for instance, a facial tissue, a bath tissue, a paper towel or the like.

45 Claims, 2 Drawing Sheets

U.S. PATENT DOCUMENTS

| | | | | |
|---|---|---|---|---|
| 5,566,724 | A | 10/1996 | Trokhan et al. | |
| 5,580,356 | A | 12/1996 | Taylor | |
| 5,595,628 | A | 1/1997 | Gordon et al. | |
| 5,601,530 | A | 2/1997 | Nielsen et al. | |
| 5,609,727 | A | 3/1997 | Hansen et al. | |
| 5,624,790 | A | 4/1997 | Trokhan et al. | |
| 5,628,876 | A | 5/1997 | Ayers et al. | |
| 5,635,191 | A | 6/1997 | Roe et al. | |
| 5,635,239 | A | 6/1997 | Chen et al. | |
| 5,688,855 | A | 11/1997 | Stoy et al. | |
| 5,698,074 | A | 12/1997 | Barcus et al. | |
| 5,718,804 | A * | 2/1998 | Jansen et al. | 162/164.6 |
| 5,731,087 | A | 3/1998 | Fan et al. | |
| 5,739,249 | A | 4/1998 | Reiners et al. | |
| 5,770,711 | A | 6/1998 | Greene et al. | |
| 5,846,383 | A | 12/1998 | Träubel et al. | |
| 5,990,333 | A | 11/1999 | Allen et al. | |
| 5,993,972 | A | 11/1999 | Reich et al. | |
| 6,007,627 | A | 12/1999 | Barnholtz | |
| 6,020,071 | A | 2/2000 | Watson | |
| 6,054,020 | A | 4/2000 | Goulet et al. | |
| 6,071,450 | A | 6/2000 | Topolkaraev et al. | |
| 6,096,152 | A | 8/2000 | Anderson et al. | |
| 6,103,064 | A | 8/2000 | Asplund et al. | |
| 6,117,438 | A | 9/2000 | Topolkaraev et al. | |
| 6,117,947 | A | 9/2000 | Wang et al. | |
| 6,117,974 | A | 9/2000 | Gilon et al. | |
| 6,172,177 | B1 | 1/2001 | Wang et al. | |
| 6,235,155 | B1 | 5/2001 | Schroeder et al. | |
| 6,274,667 | B1 | 8/2001 | Shannon et al. | |
| 6,287,418 | B1 | 9/2001 | Schroeder et al. | |
| 6,342,297 | B1 | 1/2002 | LaBrash | |
| 6,385,667 | B1 | 5/2002 | Estakhri et al. | |
| 6,432,270 | B1 | 8/2002 | Liu et al. | |
| 6,440,437 | B1 | 8/2002 | Krzysik et al. | |
| 6,666,952 | B2 * | 12/2003 | Dilts et al. | 162/158 |
| 6,670,521 | B2 | 12/2003 | Noda et al. | |
| 6,706,410 | B2 * | 3/2004 | Horenziak et al. | 428/452 |
| 2002/0132540 | A1 | 9/2002 | Soerens et al. | |
| 2003/0056917 | A1 | 3/2003 | Jimenez | |
| 2004/0040681 | A1 | 3/2004 | Ohashi et al. | |
| 2004/0118541 | A1 * | 6/2004 | Shannon et al. | 162/164.1 |
| 2004/0121158 | A1 * | 6/2004 | Shannon et al. | 428/413 |

FOREIGN PATENT DOCUMENTS

| | | | |
|---|---|---|---|
| EP | 0314128 | A1 | 5/1989 |
| EP | 0347176 | B1 | 12/1989 |
| EP | 0517890 | B1 | 12/1992 |
| EP | 0582166 | A1 | 2/1994 |
| EP | 0541511 | B1 | 8/1997 |
| EP | 0540506 | B1 | 9/1997 |
| EP | 0878179 | A2 | 11/1998 |
| EP | 0803012 | B1 | 6/1999 |
| EP | 0992252 | A2 | 4/2000 |
| EP | 1013825 | A1 | 6/2000 |
| GB | 1600963 | | 10/1981 |
| WO | WO 8909246 | A1 | 10/1989 |
| WO | WO 9713922 | A1 | 4/1997 |
| WO | WO 9956689 | A1 | 11/1999 |
| WO | WO 9967325 | A1 | 12/1999 |
| WO | WO 0056977 | A1 | 9/2000 |
| WO | WO 02066089 | A2 | 8/2002 |
| WO | WO 02066089 | A3 | 8/2002 |

OTHER PUBLICATIONS

Abstract of Japanese Patent No. 60171190, Apr. 9, 1985.
PCT Search Report, Mar. 9, 2004.
U.S. Appl. No. 10/325,461, filed Dec. 20, 2002, Shannon et al., Wiping Products Having A Low Coefficient Of Friction In The Wet State And Process For Producing Same.
Abstract of Japanese Patent 04041800 A2 Feb. 12, 1992.
Abstract of Japanese Patent 08134793 A May 28, 1996.
Abstract of Japanese Patent 11158800 A Jun. 15, 1999.
Abstract of Japanese Patent 02939008 B2 Aug. 25, 1999.
Abstract of Japanese Patent 11332777 A Dec. 7, 1999.
Abstract of Japanese Patent 11332778 A Dec. 7, 1999.
Abstract of German Patent DE19827425A1 Dec. 29, 1999.
Abstract of Japanese Patent 03109195 B2 Nov. 13, 2000.

* cited by examiner

STRENGTH ADDITIVES FOR TISSUE PRODUCTS

BACKGROUND OF THE INVENTION

In the art of tissue making and papermaking, many additives have been proposed for specific purposes, such as increasing wet strength, improving softness, or controlling wetting properties. For instance, in the past, wet strength agents have been added to paper products in order to increase the strength or otherwise control the properties of the product when contacted with water and/or when used in a wet environment. For example, wet strength agents are added to paper towels so that the paper towel can be used to wipe and scrub surfaces after being wetted without the towel disintegrating. Typical wet strength agents are also added to facial tissues to prevent the tissues from tearing when contacting fluids. In some applications, wet strength agents are also added to bath tissues to provide strength to the tissues during use. When added to bath tissues, however, the wet strength agents should not prevent the bath tissue from disintegrating when dropped in a commode and flushed into a sewer line. Typical wet strength agents added to bath tissues are sometimes referred to as temporary wet strength agents since they only maintain wet strength in the tissue for a specific length of time.

Although great advancements have been made in providing wet strength properties to paper products, various needs still exist to increase wet strength properties in certain applications, or to otherwise better control the wet strength properties of paper products.

For instance, a reoccurring need in the production of tissue products is to improve the softness of the product at a given geometric mean tensile strength. In other words, one objective in producing tissue products is to produce a product having high softness and high strength. In the past, softness was increased by adding debonders to the web which reduced hydrogen bonding of the fibers. Strength was then built back into the web by adding various strength agents, such as a polyaminoamide epichlorohydrin. Although epichlorohydrin resins are well suited for this purpose, the resins are generally not biodegradable. As such, there is a need not only to develop strength agents that improve the strength of paper webs without substantially impacting softness, but there is also a need to develop a biodegradable strength agent that can be used as a replacement to traditional epichlorohydrin resins.

SUMMARY OF THE INVENTION

The present invention is generally directed to paper products having improved strength properties due to the presence of a strength agent. The strength agent can increase the tensile strength of the paper product in either the dry state or the wet state. In one embodiment, the strength agent is added to a tissue product, such as a facial tissue, a bath tissue, a paper towel, an industrial wiper, and the like.

In one embodiment, the paper product of the present invention includes a fibrous web containing cellulosic fibers. The fibrous web is treated with a strength agent comprising a derivatized polyethylene oxide. The strength agent is present in the fibrous web in an amount sufficient to increase the tensile strength of the web.

The derivatized polyethylene oxide can contain derivative groups in an amount from about 0.5 percent to about 25 percent by weight. The derivatized polyethylene oxide can be present in the fibrous web in an amount from about 0.05 percent to about 10 percent by weight of fibers contained in the web. The derivatized polyethylene oxide can be incorporated into the fibrous web by pretreating fibers with the polymer and then forming the web. Alternatively, the derivatized polyethylene oxide can be topically applied to at least one surface of the fibrous web.

An added benefit of the strength agents disclosed in the present invention is that they can enhance the tactile feel of the product when used in the wet stated. Many textile materials have an increased coefficient of friction on their surfaces when wet. For example, clothing such as shirts and other garments are harder to put on or take off when wet or when going on over wet skin. In a like manner, many wiping products, such as facial tissues, bath tissues, paper towels, and the like, also experience this same phenomenon. For instance, tissue products typically have more drag across the surface when wet than when in the dry state. Increased drag can be noticed even if the tissue product has a smooth surface and/or has been chemically treated so as to have a very low coefficient of friction in the dry state. Thus, a tissue that is used in the wet state may have an actual tactile sensory feel that is quite different than the same tissue used in the dry state. This increased coefficient of friction may not only be less desirable to the user but may also lead to a high level of slough when wet.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
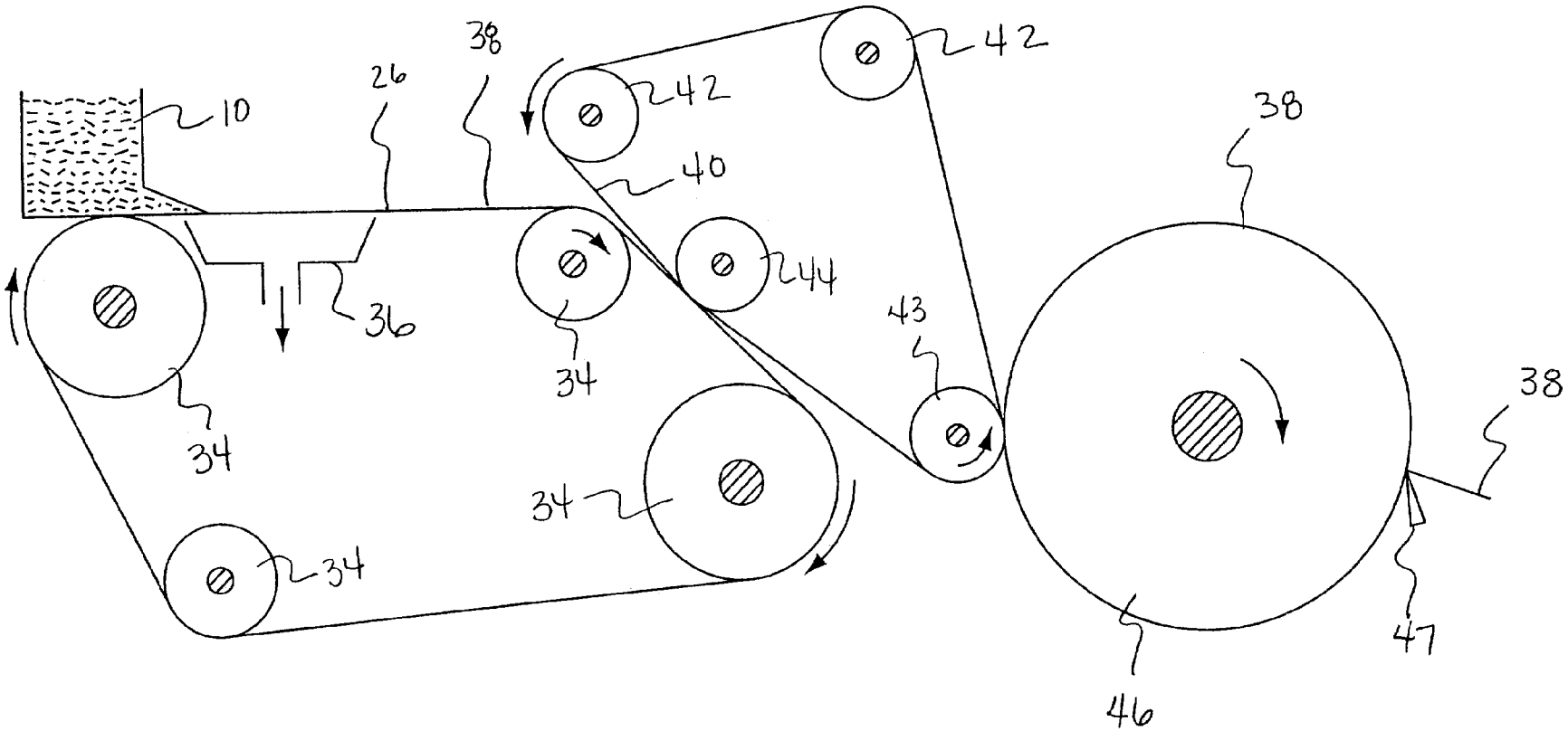
FIG. 1 is a schematic diagram of one embodiment of a process for forming paper webs that can be used in the present invention.

Repeat use of reference characters in the present specification and drawings is intended to represent same or analogous features or elements of the present invention.

DETAILED DESCRIPTION OF THE INVENTION

It is to be understood by one of ordinary skill in the art that the present discussion is a description of exemplary embodiments only, and is not intended as limiting the broader aspects of the present invention.

In general, the present invention is directed to treating a paper product, such as a tissue product, with a strength agent comprising a derivatized polyethylene oxide. For example, a base web containing pulp fibers can be treated with a derivatized polyethylene oxide. The derivatized polyethylene oxide can be crosslinked in the web to provide both wet and dry strength.

The use of a derivatized polyethylene oxide to improve the strength properties of a base web has been found to provide various advantages and benefits. For example, the present inventors have discovered that the derivatized polyethylene oxide can increase the strength of the base web without significantly impacting the stiffness of the web, which is one measure of the softness of the web. For example, it has been found that the tensile strength of the web can be increased, such as the TEA (Total Energy Absorbed) of the web, without a significant increase in the tensile modulus of the web. Furthermore, the additives of the present invention can be used to provide for an enhanced feel when the product is moist. The additives of the present invention show significantly lower coefficient of friction values when used in the moist state compared to products not containing these strength additives.

The derivatized polyethylene oxides of the present invention can be used to replace traditional epichlorohydrin resins (or any resins made from chloropropyl alcohol). The derivatized polyethylene oxides are more environmentally friendly and are generally biodegradable. Thus, paper webs can be produced having improved strength properties without containing any of the epichlorohydrin resins used in the past. It may, however, at times be advantageous to use the strength additives of the present invention in conjunction with the standard polyamidoamine epichlorohydrin resins broadly known in the art.

A derivatized polyethylene oxide may be formed by reacting a polyethylene oxide with one or more monomers to provide a functional group on the polyethylene oxide polymer. The derivative groups can be placed in the backbone of the polyethylene oxide or can be pendent groups. The derivative groups can be present in the polymer in an amount from about 0.5 percent to about 25 percent by weight, such as from about 0.5 percent to about 10 percent by weight.

Prior to being derivatized, polyethylene oxides can have the following general formula:

$$R^1O—(CH_2CH_2O)_nR^2$$

wherein $R^1$ and $R^2$ are hydrogen or organofunctional groups. $R^1$ and $R^2$ can be the same or different.

In general, the molecular weight of the polyethylene oxide that is derivatized is not critical as long as enough derivatized groups can be placed on the polymer that are capable of crosslinking in sufficient quantity with cellulose for a desired result. For many applications, the molecular weight of the polyethylene oxide that is derivatized is greater than about 20,000, and particularly greater than about 50,000. As used herein, molecular weight can be determined by rheological measurements. In one embodiment, for instance, the polyethylene oxide can have a molecular weight of from about 100,000 to about 2 million.

High molecular weight polyethylene oxides are available from various commercial sources. Examples of polyethylene oxide resins that can be derivatized and used in the present invention are commercially available from the Union Carbide Corporation and are sold under the trade designations POLYOX N-205, POLYOX N-750, POLYOX WSR N-10 and POLYOX WSR N-80. The above four products are believed to have molecular weights of from about 100,000 to about 600,000 (g-mol). The polyethylene oxide resins may optionally contain various additives such as plasticizers, processing aids, rheology modifiers, antioxidants, UV light stabilizers, pigments, colorants, slip additives, antiblock agents, etc.

In one embodiment, a derivatized polyethylene oxide for use in the present invention can be formed by grafting monomers onto the polyethylene oxide. The grafting is accomplished by mixing polyethylene oxide with one or more monomers and an initiator and applying heat. Such treated polyethylene oxide compositions are disclosed in U.S. Pat. No. 6,172,177 to Wang et al., which is incorporated herein by reference.

In one embodiment, a variety of polar vinyl monomers may be useful in the practice of the present invention. The term "monomer" as used herein includes monomers, oligomers, polymers, mixtures of monomers, oligomers, and/or polymers, and any other reactive chemical species which are capable of covalent bonding with polyethylene oxide. Ethylenically unsaturated polar vinyl monomers that may be used to derivatize a polyethylene oxide can include as a functional group hydroxyl, carboxyl, amino, carbonyl, halo, thiol, sulfonic, sulfonate, amine, amide, aldehyde, epoxy, silanol, azetidinium groups and the like. In an alternative embodiment the polyethylene oxide may be derivatized with a group that can be further reacted upon in a subsequent step to give a derivatized polyethylene oxide material of the present invention.

When forming a derivatized polyethylene oxide an initiator may be useful in forming the polymer. The initiator can generate free radicals when subjected to energy, such as the application of heat.

Compounds containing an O—O, S—S, or N═N bond may be used as thermal initiators. Compounds containing O—O bonds; i.e., peroxides, are commonly used as initiators for graft polymerization. Such commonly used peroxide initiators include: alkyl, dialkyl, diaryl and arylalkyl peroxides such as cumyl peroxide, t-butyl peroxide, di-t-butyl peroxide, dicumyl peroxide, cumyl butyl peroxide, 1,1-di-t-butyl peroxy-3,5,5-trimethylcyclohexane, 2,5-dimethyl-2,5-di(t-butylperoxy)hexane, 2,5-dimethyl-2,5-bis(t-butylperoxy)hexyne-3 and bis(a-t-butyl peroxyisopropylbenzene); acyl peroxides such as acetyl peroxides and benzoyl peroxides; hydroperoxides such as cumyl hydroperoxide, t-butyl hydroperoxide, p-methane hydroperoxide, pinane hydroperoxide and cumene hydroperoxide; peresters or peroxyesters such as t-butyl peroxypivalate, t-butyl peroctoate, t-butyl perbenzoate, 2,5-dimethylhexyl-2,5-di(perbenzoate) and t-butyl di(perphthalate); alkylsulfonyl peroxides; dialkyl peroxymonocarbonates; dialkyl peroxydicarbonates; diperoxyketals; ketone peroxides such as cyclohexanone peroxide and methyl ethyl ketone peroxide. Additionally, azo compounds such as 2,2'-azobisisobutyronitrile abbreviated as AIBN, 2,2'-azobis(2,4-dimethylpentanenitrile) and 1,1'-azobis(cyclohexanecarbonitrile) may be used as the initiator. Graft copolymers that are useful in the subject coatings have been demonstrated in the following Examples by the use of a liquid, organic peroxide initiator available from R.T. Vanderbilt Company, Inc. of Norwalk, Conn., sold under the trade designation VAROX DBPH peroxide which is a free radical initiator and comprises 2,5-bis(tert butylperoxy)-2,5-dimethyl hexane along with smaller amounts of di(tert butylperoxide). Other initiators may also be used, such as LUPERSOL® 101 and LUPERSOL® 130 available from Elf Atochem North America, Inc. of Philadelphia, Pa.

In one embodiment, the formation of a derivatized polyethylene oxide for use in the present invention can be illustrated as follows:

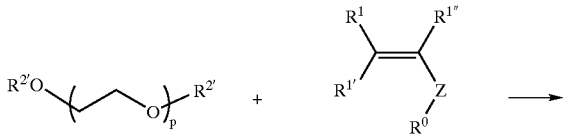

-continued

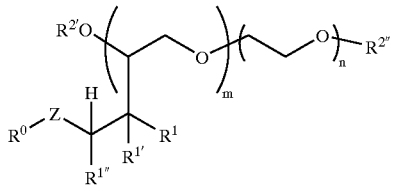

wherein $R^1$, $R^{1'}$, $R^{1''}$ are independently H or a $C_{1-4}$alkyl, Z is any bridging radical whose purpose is to incorporate the $R^0$ moiety into the ethylenically unsaturated monomer, and $R^0$ is any group capable of or containing a constituent capable of forming covalent, ionic and/or hydrogen bonds with cellulose or with the polymer itself. $R^{2'}$ and $R^{2''}$ are any suitable polyoxyethylene endgroups including but not limited to H, alkyl, aryl, alkyl esters, alkyl amides, sulfonates and substituted derivatives thereof. p is an integer greater than or equal to about 350 and m and n are integers such that m+n=p. Examples of suitable Z groups include but are not limited to —O—, —S—, —OOC—, —COO—, —HNOC—, and —CONH. Suitable $R^0$ functional groups include H, amine, amide, carboxyl, hydroxyl, aldehyde, epoxy, silanol and azetidinium groups. The materials may incorporate a second ethylenically unsaturated monomer whose purpose is to provide a charge or basis for charge development within the polymer. The charge is preferably cationic but may be anionic or amphoteric. Incorporation of such charge now makes the material substantive to cellulose in a wet end application.

It should also be understood that the derivatized groups may be present in the polymer in a block or a random pattern. That is they may be adjacent to other derivatized groups or may be adjacent to non-derivatized groups within the polymer.

In one particular embodiment, the polyethylene oxide polymer is grafted with an amount of an organic moiety that includes a group that reacts with water to form a silanol group. For example, one such functional group that can react with water to form a silanol group is a trialkoxy silane functional group. The trialkoxy silane functional group can have the following structure:

wherein $R_1$, $R_2$ and $R_3$ are the same or different alkyl groups, each independently

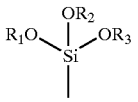

having 1 to 6 carbon atoms.

In forming derivatized polyethylene oxides that form a silanol group, the polyethylene oxide can be reacted with a monomer containing, for instance, a trialkoxy silane functional group as illustrated above. For example, in one embodiment, the monomer is an acrylate or methacrylate, such as methacryloxypropyl trimethoxy silane. Methacryloxypropyl propyl trimethoxy silane is commercially available from Dow Corning out of Midland, Mich. under the trade designation Z-6030 Silane.

Other suitable monomers containing a trialkoxy silane functional group include, but are not limited to, methacryloxyethyl trimethoxy silane, methacryloxypropyl triethoxy silane, methacryloxypropyl tripropoxy silane, acryloxypropylmethyl dimethoxy silane, 3-acryloxypropyl trimethoxy silane, 3-methacryloxypropylmethyl diethoxy silane, 3-methacryloxypropylmethyl dimethoxy silane, and 3-methacryloxypropyl tris(methoxyethoxy) silane. However, it is contemplated that a wide range of vinyl and acrylic monomers having trialkoxy silane functional groups or a moiety that reacts easily with water to form a silanol group, such as a chlorosilane or an acetoxysilane, provide the desired effects to PEO and are effective monomers for grafting in accordance with the copolymers of the present invention.

When reacting a polyethylene oxide with methacryloxypropyl trimethoxy silane to form a derivatized polyethylene oxide, the equation can be represented as follows:

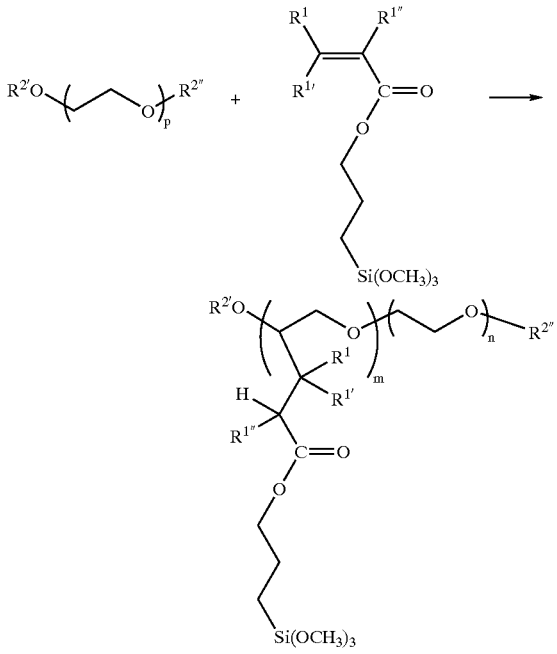

wherein $R^{2'}$, $R^{2''}$, $R^1$, $R^{1'}$, $R^{1''}$, m, n and p are as previously defined.

The above described derivatized polyethylene oxides will generally yield more permanent-type strength agents. The derivatized polyethylene oxide polymers, however, can be converted into temporary wet strength agents through the process of glyoxylation. More particularly, temporary wet strength agents may be formed by glyoxylating polyethylene oxides polymers grafted with acrylamide or methacrylamide groups. Such a reaction can be represented as follows:

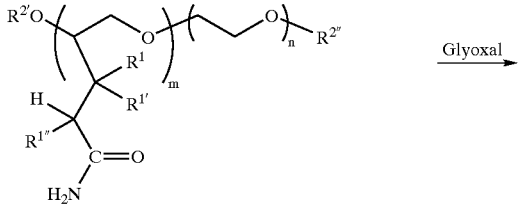

-continued

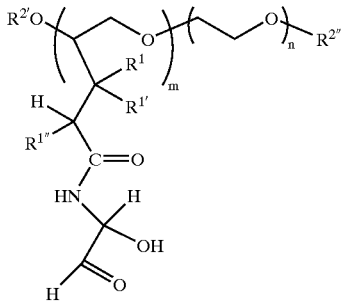

wherein $R^1$, $R^{1'}$, $R^{1''}$, $R^{2'}$, $R^{2''}$, m and n are as described above.

Glyoxylating the derivatized polyethylene oxide polymer forms hemiacetal bonds with cellulose and aldehydes that may degrade or break down when contacted with water, thus producing the temporary effect.

It is believed that once a derivatized polyethylene oxide as described above is applied to a base web, the polymer causes cellulose to crosslink accounting for the increase in strength. In particular, it is believed that the multiple derivatized sites on the polyethylene oxide polymer are capable of intrapolymer crosslinking or crosslinking with cellulose. Further, the crosslinking can be moisture induced.

When treating base webs in accordance with the present invention, the derivatized polyethylene oxide can be applied to the base web topically or can be incorporated into the base web by being pre-mixed with the fibers that are used to form the web. When applied topically, any suitable topical application process can be used. For example, in one embodiment, the derivatized polyethylene oxide can be combined with a solvent and applied to a base web. Of particular advantage, it is believed that almost any liquid can be used as a solvent. For instance, the solvent can be an organic solvent, such as an alcohol, ketone, aldehyde, alkane, alkene, aromatic, or mixtures thereof. Alternatively, the solvent can be water. For example, many derivatized polyethylene oxides can be dissolved in water under high shear.

When applied as a solution, the derivatized polyethylene oxide can be sprayed onto the base web or printed onto the base web. Any suitable printing device, for instance, may be used. For example, an ink jet printer or a rotogravure printing machine may be used.

When applied as a solution, the derivatized polyethylene oxide can be contained within the solution in an amount from about 2 percent to about 50 percent by weight. It should be understood, however, that more or less of the derivatized polyethylene oxide can be contained in the solution depending on the molecular weight of the polymer and the type of application process that is used.

In one embodiment, the derivatized polyethylene oxide polymer can be heated prior to or during application to a base web. Heating the composition can lower the viscosity for facilitating application. In one embodiment, the derivatized polyethylene oxide can be heated and extruded onto a base sheet. Any suitable extrusion device can be used, such as a meltblown die. When extruding the polymer onto a base web, the derivatized polyethylene oxide can be applied in a neat form.

When topically applied, the derivatized polyethylene oxide can be applied to one side or to both sides of the base web. Further, the composition can be applied to cover 100 percent of the surface area of the base web or can be applied in a pattern that includes treated areas and untreated areas.

When applied topically, the derivatized polyethylene oxide composition can also be applied to the base web at different points in the production of the base web. For example, the derivatized polyethylene oxide polymer can be applied while the base web is still wet or after the web has been dried.

As described above, in addition to being topically applied, the derivatized polyethylene oxide can also be applied to fibers prior to formation to the base web. For example, in one embodiment, the derivatized polyethylene oxide can be added to an aqueous suspension of fibers that are used to form a paper web. The derivatized polyethylene oxide can bond to the fibers and become incorporated into a web formed from the fibers.

The amount of derivatized polyethylene oxide applied to base webs in accordance with the present invention can vary depending upon the particular application. For example, the amount applied to the web can vary depending upon the actual derivatized polyethylene oxide used, the construction of the paper web, and the desired results. For example, in many applications, the derivatized polyethylene oxide can be added to a base web in an amount from about 0.05 percent to about 10 percent by weight of fibers present within the web.

In general, any suitable base web may be treated in accordance with the present invention. For example, in one embodiment, the base sheet can be a tissue product, such as a bath tissue, a facial tissue, a paper towel, an industrial wiper, and the like. Tissue products typically have a bulk density of at least 2 cc/g. The tissue products can contain one or more plies and can be made from any suitable types of fiber.

Fibers suitable for making paperwebs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988 to Laamanen et al.; U.S. Pat. No. 4,594,130, issued Jun. 10, 1986 to Chang et al.; and U.S. Pat. No. 3,585,104. Useful fibers can also be produced by anthraquinone pulping, exemplified by U.S. Pat. No. 5,595,628 issued Jan. 21, 1997, to Gordon et al. A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present invention include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

In general, any process capable of forming a paperweb can also be utilized in the present invention. For example, a papermaking process of the present invention can utilize creping, wet creping, double creping, embossing, wet pressing, air pressing, through-air drying, creped through-air drying, uncreped through-air drying, hydroentangling, air laying, as well as other steps known in the art.

Also suitable for products of the present invention are tissue sheets that are pattern densified or imprinted, such as the tissue sheets disclosed in any of the following U.S. Pat. No. 4,514,345 issued on Apr. 30, 1985, to Johnson et al.; U.S. Pat. No. 4,528,239 issued on Jul. 9, 1985, to Trokhan; U.S. Pat. No. 5,098,522 issued on Mar. 24, 1992; U.S. Pat. No. 5,260,171 issued on Nov. 9, 1993, to Smurkoski et al.; U.S. Pat. No. 5,275,700 issued on Jan. 4, 1994, to Trokhan; U.S. Pat. No. 5,328,565 issued on Jul. 12, 1994, to Rasch et al.; U.S. Pat. No. 5,334,289 issued on Aug. 2, 1994, to Trokhan et al.; U.S. Pat. No. 5,431,786 issued on Jul. 11, 1995, to Rasch et al.; U.S. Pat. No. 5,496,624 issued on Mar. 5, 1996, to Steltjes, Jr. et al.; U.S. Pat. No. 5,500,277 issued on Mar. 19, 1996, to Trokhan et al.; U.S. Pat. No. 5,514,523 issued on May 7, 1996, to Trokhan et al.; U.S. Pat. No. 5,554,467 issued on Sep. 10, 1996, to Trokhan et al.; U.S. Pat. No. 5,566,724 issued on Oct. 22, 1996, to Trokhan et al.; U.S. Pat. No. 5,624,790 issued on Apr. 29, 1997, to Trokhan et al.; and, U.S. Pat. No. 5,628,876 issued on May 13, 1997, to Ayers et al., the disclosures of which are incorporated herein by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits was deflected by an air pressure differential across the deflection conduit to form a lower-density pillow-like region or dome in the tissue sheet.

For example, referring to FIG. 1, one embodiment of a process for producing a base web that may be used in accordance with the present invention is illustrated. The process illustrated in the figure depicts a wet-lay process, although, as described above, other techniques for forming the base web of the present invention may be used.

As shown in FIG. 1, the web-forming system includes a headbox 10 for receiving an aqueous suspension of fibers. Headbox 10 spreads the aqueous suspension of fibers onto a forming fabric 26 that is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. The speed at which fabric 40 can be driven is approximately the same speed at which fabric 26 is driven so that movement of web 38 through the system is consistent. Alternatively, the two fabrics can be run at different speeds, such as in a rush transfer process, in order to increase the bulk of the webs or for some other purpose.

From fabric 40, web 38, in this embodiment, is pressed onto the surface of a rotatable heated dryer drum 46, such as a Yankee dryer, by a press roll 43. Web 38 is lightly pressed into engagement with the surface of dryer drum 46 to which it adheres, due to its moisture content and its preference for the smoother of the two surfaces. As web 38 is carried through a portion of the rotational path of the dryer surface, heat is imparted to the web causing most of the moisture contained within the web to be evaporated.

Web 38 is then removed from dryer drum 46 by a creping blade 47. Creping web 38 as it is formed reduces internal bonding within the web and increases softness.

In an alternative embodiment, instead of wet pressing the base web 38 onto a dryer drum and creping the web, the web can be through-air dried. A through-air dryer accomplishes the removal of moisture from the base web by passing air through the web without applying any mechanical pressure.

Figure 2:
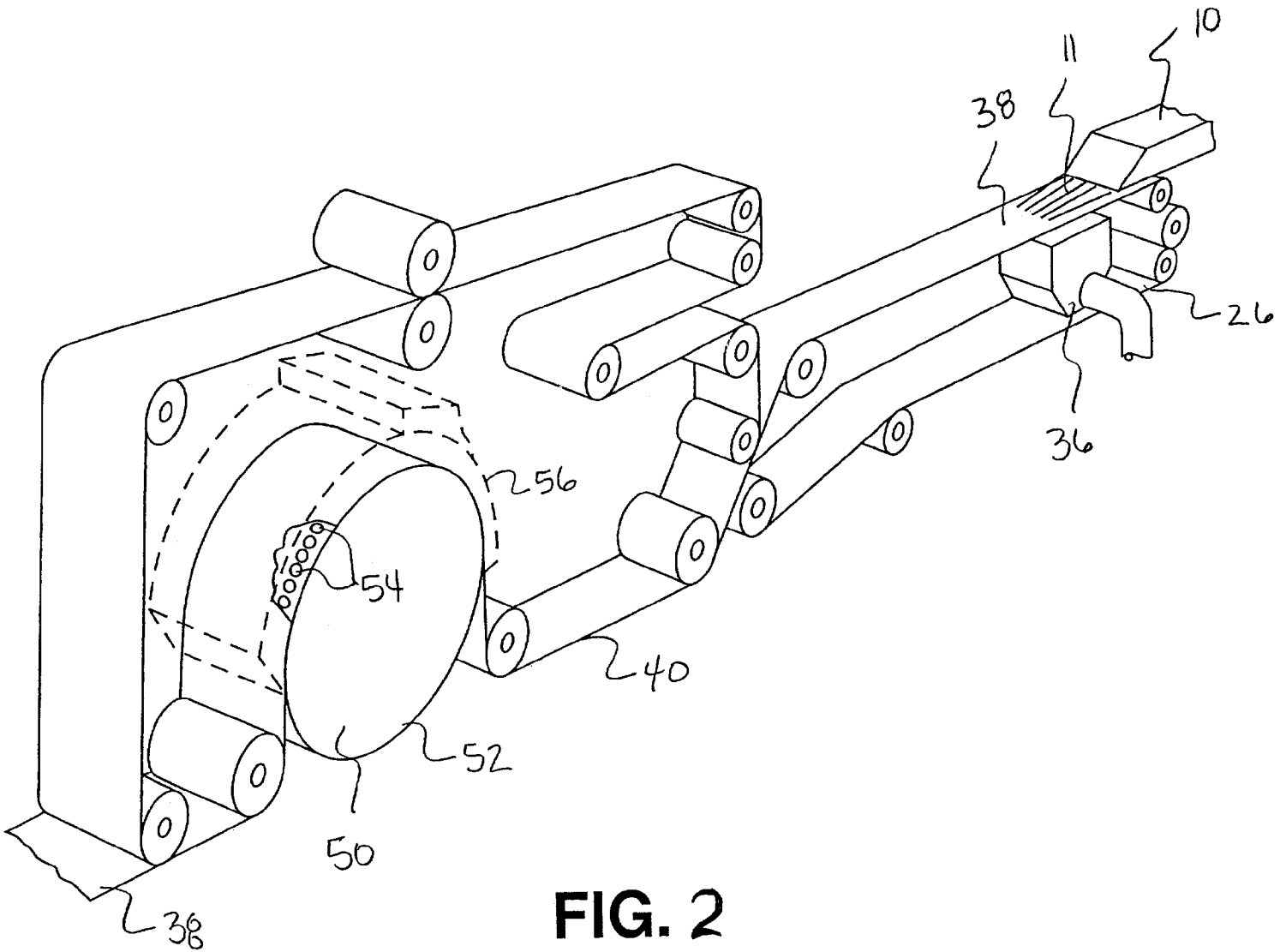
FIG. 2 is a perspective view of another alternative embodiment of a process for producing paper webs that may be used in the present invention.

For example, referring to FIG. 2, an alternative embodiment for forming a base web for use in the process of the present invention containing a through-air dryer is illustrated. As shown, a dilute aqueous suspension of fibers is supplied by a headbox 10 and deposited via a sluice 11 in uniform dispersion onto a forming fabric 26 in order to form a base web 38.

Once deposited onto the forming fabric 26, water is removed from the web 38 by combinations of gravity, centrifugal force and vacuum suction depending upon the forming configuration. As shown in this embodiment, and similar to FIG. 1, a vacuum box 36 can be disposed beneath the forming fabric 26 for removing water and facilitating formation of the web 38.

From the forming fabric 26, the base web 38 is then transferred to a second fabric 40. The second fabric 40 carries the web through a through-air drying apparatus 50. The through-air dryer 50 dries the base web 38 without applying a compressive force in order to maximize bulk. For example, as shown in FIG. 2, the through-air drying apparatus 50 includes an outer rotatable cylinder 52 with perforations 54 in combination with an outer hood 56. Specifically, the fabric 40 carries the web 38 over the upper portion of the through-air drying apparatus outer cylinder 52. Heated air is drawn through perforations 54 which contacts the web 38 and removes moisture. In one embodiment, the temperature of the heated air forced through the perforations 54 can be from about 170° F. to about 500° F.

In one embodiment, the second fabric 40 can be moving at a slower speed than the forming fabric 26 in a process known as rush transfer. The base web is transferred from the forming fabric to the dryer fabric (optionally a transfer fabric can be interposed between the forming fabric and the dryer fabric) traveling at a slower speed than the forming fabric in order to impart increased stretch into the web. Transfer can be carried out with the assistance of a vacuum shoe and a fixed gap or space between the forming fabric and the dryer fabric or a kiss transfer to avoid compression of the wet web. The second fabric 40 can be traveling at a speed, for instance, that is from about 5 percent to about 60 percent slower than the forming fabric.

The tissue sheets containing the derivatized polyethylene oxide polymers of the present invention may be blended or layered sheets, wherein either a heterogeneous or homogeneous distribution of fibers is present in the z-direction of the sheet. At times it may be advantageous to add the strength agent to all the fibers in the sheet. At other times it may be advantageous to add the strength agent only selective fibers in the sheet, such methods being well known to those skilled in the art. In a specific embodiment of the present invention the tissue sheet is a layered tissue sheet comprising two or more layers comprising distinct hardwood and softwood layers, wherein the strength agents of the present invention are added to only the hardwood fibers. In another specific embodiment the tissue product is a single ply tissue product, comprising either a blended or layered sheet, wherein the strength agent is selectively applied to the exterior surface or exterior layers of the tissue ply. In another specific embodiment, the tissue product is a multi-ply tissue product wherein the strength agents of the present invention are selectively applied to the two exterior facing surfaces of the multi-ply tissue product or to the exterior facing layer of each tissue ply. In yet another specific embodiment of the present invention the tissue sheet is a layered tissue sheet comprising two or more layers comprising distinct hardwood and softwood layers, wherein the strength agents of the present invention are added to only the softwood fibers.

Optional Chemical Additives

Optional chemical additives may also be added to the aqueous papermaking furnish or to the embryonic tissue sheet to impart additional benefits to the product and process and are not antagonistic to the intended benefits of the present invention. The following materials are included as examples of additional chemicals that may be applied to the tissue sheet with the derivatized polyethylene oxides of the present invention. The chemicals are included as examples and are not intended to limit the scope of the present invention. Such chemicals may be added at any point in the papermaking process, such as before or after addition of the derivatized polyethylene oxide polymers of the present invention. They may also be added simultaneously with the derivatized polyethylene oxide polymers, either blended with the derivatized polyethylene oxide copolymers of the present invention or as separate additives.

Charge Control Agents

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Strength Agents

At times it may be advantageous to employ additional wet and dry strength agents to the tissue sheet. As used herein, "wet strength agents" refer to materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a tissue sheet or sheet results in providing the tissue sheet with a mean wet geometric tensile strength:dry geometric tensile strength ratio in excess of about 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50% of its original wet strength after exposure to water for a period of at least five minutes. Temporary wet strength agents are those which show about 50% or less than, of their original wet strength after being saturated with water for five minutes. Both classes of wet strength agents find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will typically provide a more or less long-term wet resilience to the structure of a tissue sheet. In contrast, the temporary wet strength agents will typically provide tissue sheet structures that had low density and high resilience, but would not provide a structure that had long-term resistance to exposure to water or body fluids.

Wet and Temporary Wet Strength Agents

The temporary wet strength agents may be cationic, nonionic or anionic. Such compounds include PAREZ™ 631 NC and PAREZ® 725 temporary wet strength resins that are cationic glyoxylated polyacrylamide available from Cytec Industries (West Paterson, N.J.). This and similar resins are described in U.S. Pat. No. 3,556,932 issued on Jan. 19, 1971, to Coscia et al. and U.S. Pat. No. 3,556,933 issued on Jan. 19, 1971, to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemical Company and other aldehyde containing polymers such as those described in U.S. Pat. No. 6,224,714 issued on May 1, 2001, to Schroeder et al.; U.S. Pat. No. 6,274,667 issued on Aug. 14, 2001, to Shannon et al.; U.S. Pat. No. 6,287,418 issued on Sep. 11, 2001, to Schroeder et al.; and, U.S. Pat. No. 6,365,667 issued on Apr. 2, 2002, to Shannon et al., the disclosures of which are herein incorporated by reference to the extend they are non-contradictory herewith.

Permanent wet strength agents comprising cationic oligomeric or polymeric resins can be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. 3,700,623 issued on Oct. 24, 1972, to Keim; U.S. Pat. No. 3,772,076 issued on Nov. 13, 1973, to Keim; U.S. Pat. No. 3,855,158 issued on Dec. 17, 1974, to Petrovich et al.; U.S. Pat. No. 3,899,388 issued on Aug. 12, 1975, to Petrovich et al.; U.S. Pat. No. 4,129,528 issued on Dec. 12, 1978, to Petrovich et al.; U.S. Pat. No. 4,147,586 issued on Apr. 3, 1979, to Petrovich et al.; and, U.S. Pat. No. 4,222,921 issued on Sep. 16, 1980, to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry Strength Agents

Dry strength agents may also be applied to the tissue sheet without affecting the performance of the disclosed cationic synthetic co-polymers of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. It may at times, however, be beneficial to blend the dry strength agent with the additives of the present invention and apply the two chemicals simultaneously to the tissue sheet.

Softening Agents

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2 HT-75 (di(hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

Additional softeners may be applied topically to enhance the surface feel of the product. An especially preferred topical softener for this application is polysiloxane. The use of polysiloxanes to soften tissue sheets is broadly taught in the art. A large variety of polysiloxanes are available that are capable of enhancing the tactile properties of the finished tissue sheet. Any polysiloxane capable of enhancing the tactile softness of the tissue sheet is suitable for incorporation. Examples of suitable polysiloxanes include but are not limited to linear polydialkyl polysiloxanes such as the DC-200 fluid series available from Dow Corning, Inc., Midland, Mich. as well as the organofunctional polydimethyl siloxanes such as the preferred amino functional polydimethyl siloxanes. Examples of suitable polysiloxanes include those described in U.S. Pat. No. 6,054,020 issued on Apr. 25, 2000, to Goulet et al. and U.S. Pat. No. 6,432,270 issued on Aug. 13, 2002, to Liu et al., the disclosures of which are herein incorporated by reference to the extent that they are non-contradictory herewith. Additional exemplary aminofunctional polysiloxanes are the Wetsoft CTW family manufactured and sold by Wacker Chemie, Munich, Germany.

Miscellaneous Agents

It may be desirable to treat the tissue sheet with additional types of chemicals.

Such chemicals include, but are not limited to, absorbency aids usually in the form of cationic, anionic, or non-ionic surfactants, humectants and plasticizers such as low molecular weight polyethylene glycols and polyhydroxy compounds such as glycerin and propylene glycol.

In general, the derivatized polyethylene oxide polymers of the present invention may be used in conjunction with any known materials and chemicals that are not antagonistic to its intended use. Examples of such materials and chemicals include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, polysiloxanes and the like. A wide variety of other materials and chemicals known in the art of papermaking and tissue production may be included in the tissue sheets of the present invention including lotions and other materials providing skin health benefits such as aloe extract and tocopherols such as vitamin E.

The basis weight of paper webs used in the present invention can vary depending upon the particular application. In general, for most applications, the basis weight can be from about 6 gsm to about 140 gsm, and particularly from about 10 gsm to about 80 gsm. For example, bath tissues and facial tissues typically have a basis weight of less than about 40 gsm. Paper towels, on the other hand, typically have a basis weight of greater than about 30 gsm.

The present invention may be better understood with respect to the following example.

EXAMPLE

A derivatized polyethylene oxide was formed having the following formula:

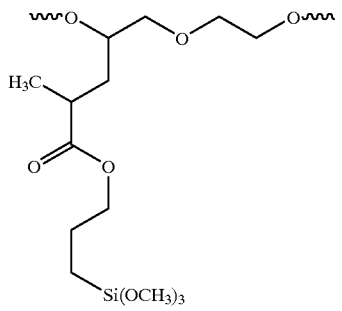

The polyethylene oxide used in this example had a molecular weight of 100,000 and incorporated 6 percent by weight silanol groups.

An aqueous solution containing 1.5 percent of the above silanol functional high molecular weight polyethylene oxide was prepared by dissolving the polymer in distilled water under high shear. The solution was placed in an air pressured spraying device and sprayed on an upcreped through-air dried bath base sheet containing no chemical. The base sheet had a basis weight of 18.5 lbs. per 2,880 sq. ft. Approximately 1 gram of solution was added per 0.2 grams of basesheet. The sheet was then dried in a convection oven at 120° C. for 5 minutes.

Treated samples and untreated samples of the base sheet were tested in the machine direction and the cross machine direction on a tensile strength tester. The samples were tested in the dry state and in the wet state. Specifically, the following tests were performed.

Tensile strengths are measured according to Tappi Test Method T 494 om-88 for tissue, modified in that an MTS SINTECH.RTM. 1/G tensile tester (or equivalent) is used having a 3-inch jaw width, a jaw span of 4 inches, and a crosshead speed of 10 inches per minute. Wet strength is measured in the same manner as dry strength except that the tissue sample is folded without creasing about the midline of the sample, held at the ends, and dipped in deionized water for about 0.5 seconds to a depth of about 0.5 cm to wet the central portion of the sample, whereupon the wetted region is touched for about 1 second against an absorbent towel to remove excess drops of fluid, and the sample is unfolded and set into the tensile tester jaws and immediately tested. The sample is conditioned under TAPPI conditions (50% RH, 22.7.degree. C.) before testing. Generally 3 samples are combined for wet tensile testing to ensure that the load cell reading is in an accurate range.

Tensile index (TI) is a measure of tensile strength normalized for basis weight of the web tested in both dry and wet states. Tensile strength can be converted to tensile index by converting tensile strength determined in units of grams of force per 3 inches to units of Newtons per meter and dividing the result by the basis weight in grams per square meter of the tissue, to give the tensile index in Newton-meters per gram (Nm/g).

Wet/Dry TI Ratio (% Wet/Dry TI) is the wet TI divided by the dry TI multiplied by 100.

TEA($J/m^2$) is the total-energy-absorbed in the dry state at maximum load during the tensile strength test.

Elastic Modulus (Maximum Slope) E($kg_f$) is the elastic modulus determined in the dry state and is expressed in units of kilograms of force. Tappi conditioned samples with a width of 3 inches are placed in tensile tester jaws with a gauge length (span between jaws) of 2 inches. The jaws move apart at a crosshead speed of 25.4 cm/min and the slope is taken as the least squares fit of the data between stress values of 50 grams of force and 100 grams of force, or the least squares fit of the data between stress values of 100 grams of force and 200 grams of force, whichever is greater. If the sample is too weak to sustain a stress of at least 200 grams of force without failure, an additional ply is repeatedly added until the multi-ply sample can withstand at least 200 grams of force without failure.

Peak load (g) is the maximum load prior to failure of the sample.

Geometric Mean Tensile Strength (g/in) is the square root of the product of the machine direction tensile strength and the cross machine direction tensile strength.

GMM is the geometric mean modulus.

In this example, the following results were obtained:

| | TEA | PEAK LOAD | TENSILE INDEX | MAX SLOPE | SLOPE/ LOAD | TEA/ LOAD |
|---|---|---|---|---|---|---|
| MD Treated | 10.03 | 695 | 4.47 | 11.7 | 0.017 | 0.0144 |
| CD Treated | 2.81 | 415 | 2.67 | 15.7 | 0.038 | 0.0068 |
| MD Control | 6.37 | 458 | 2.96 | 8.0 | 0.018 | 0.0139 |
| CD Control | 1.25 | 248 | 1.60 | 12.0 | 0.048 | 0.0050 |

| | GMT | GMM/ GMT* 100 | GM TEA/ GMT *100 | CD WET/ CD DRY RATIO |
|---|---|---|---|---|
| Treated | 537 | 2.52 | 0.99 | 13% |
| Untreated | 337 | 2.91 | 0.84 | 6% |

In addition, the static and dynamic coefficients of friction were measured on the control and treated samples. The treated sample showed significantly less increase in the coefficient of friction between the dry and wet states than the control. The treated tissue was noted as having an increased lubricious feel in the wet state than the control tissue as noted in the following table. The following procedure was used to measure the co-efficient of friction of the samples:

COF and wet COF testing was conducted using a TMI Slip & Friction tester available from Testing Machines Inc., Ronkonkoma, N.Y. Samples were conditioned at 23° C.±1° C. and 50±2% relative humidity for a minimum of 4 hours prior to testing. Testing was done on a smooth acrylic sheet with a ¼" caulk dam around the perimeter of the acrylic sheet to hold water. The acrylic sheet was placed on the instrument so the sled would move along the acrylic sheet. The sample sheets were cut to a 6.35 cm width and sufficient length to be clamped in the sled. The sample was then placed and secured in the test sled. The method for measuring dry and wet COF values was identical except for the addition of water. For wet COF testing, about 15 cc of water was placed in front of the sled. Sufficient water was added to completely saturate the sheet so as the entire test was run with the sheet completely wet. All sheets were backed with clear acrylic tape to prevent disintegration of the sheet in the water. All COF units are in grams. Specific test parameters were as follows:

Delay—5 seconds,
Sled—200 grams, 6.35×6.35 cm
Static Duration—2000 ms
Static speed—1 cm/min
Kinetic Speed—15.25 cm/min
Kinetic Length —20.5 cm

| | Control | Invention |
|---|---|---|
| Static COF Dry | 47 | 65 |
| Static COF Wet | 67 | 56 |
| Change (%) | +42 | −14 |
| Kinetic COF Dry | 60 | 51 |
| Kinetic COF Wet | 83 | 59 |
| Change (%) | +38 | +16 |

As shown above, the derivatized polyethylene oxide dramatically improved the strength of the base sheet while significantly reducing the change in coefficient of friction between the dry and wet states.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

The invention claimed is:

1. A paper product having improved strength properties comprising:

a fibrous web containing cellulosic fibers, the fibrous web being treated with a strength agent comprising a derivatized polyethylene oxide, the strength agent being present in an amount sufficient to increase the tensile strength of the fibrous web, said derivatized polyethylene oxide comprising:

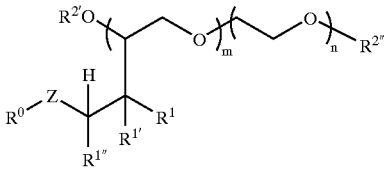

wherein $R^1$, $R^{1'}$, $R^{1''}$ are independently H or a $C_{1-4}$ alkyl;

Z is any bridging radical whose purpose is to incorporate the $R^0$ moiety into the ethylenically unsaturated monomer;

$R^0$ is any group capable of or containing a constituent capable of forming covalent, ionic and/or hydrogen bonds with cellulose or with the polymer itself;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof;

p is an integer greater than or equal to about 350; and m and n are integers such that m+n=p.

2. A paper product as defined in claim 1, wherein the fibrous web has a bulk density of at least 2 cc/g.

3. A paper product of claim 1 having a static coefficient of friction in the wet state no more than 10% greater than the static coefficient of friction in the dry state.

4. A paper product of claim 1 having a kinetic coefficient of friction in the wet state no more than 20% greater than the kinetic coefficient of friction in the wet state.

5. A paper product of claim 1, wherein Z is selected from the group comprising —O—, —S—, —OOC—, —COO—, —NHCO—, —CONH and mixtures thereof and $R^0$ is selected from the group comprising hydrogen, amine, amide, carboxyl, hydroxyl, aldehyde, epoxy, silanol, azetidinium and mixtures thereof.

6. A paper product as defined in claim 1, wherein the derivatized polyethylene oxide comprises a silanol derivatized polyethylene oxide.

7. A paper product as defined in claim 6, wherein the silanol derivatized polyethylene oxide comprises:

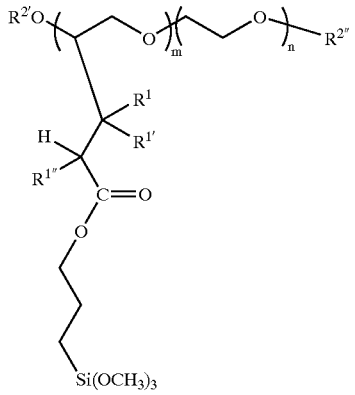

wherein $R^1$, $R^{1'}$, $R^{1''}$ are independently H or a $C_{1-4}$ alkyl;

$R^{2'}$ and $R^{2''}$ are any suitable polyoxyethylene endgroups selected from the group of to H, alkyl, aryl, alkyl esters, alkyl amides, sulfonates, substituted derivatives and mixtures thereof; and m and n are integers such that m+n is greater than or equal to 350.

8. A paper product as defined in claim 1, wherein the polyethylene oxide contained in the derivatized polyethylene oxide has a molecular weight of at least 20,000.

9. A paper product as defined in claim 1, wherein the paper product comprises a facial tissue, a bath tissue, or a paper towel.

10. A paper product as defined in claim 1, wherein the derivatized polyethylene oxide contains derivative groups in an amount from about 0.5% to about 25% by weight.

11. A paper product as defined in claim 1, wherein the derivatized polyethylene oxide is present in the fibrous web in an amount from about 0.05% to about 10% by weight of fibers contained in the fibrous web.

12. A paper product as defined in claim 1, wherein the derivatized polyethylene oxide has been applied topically to at least one surface of the fibrous web.

13. A paper product as defined in claim 12, wherein the derivatized polyethylene has been applied to both sides of the fibrous web.

14. A paper product as defined in claim 1, wherein the derivatized polyethylene oxide is cationic.

15. A paper product as defined in claim 1, wherein the derivatized polyethylene oxide comprises a polyethylene oxide that has been grafted with an acrylamide or a methacrylamide followed by glyoxylation.

16. A paper product as defined in claim 15, wherein the derivatized polyethylene oxide comprises:

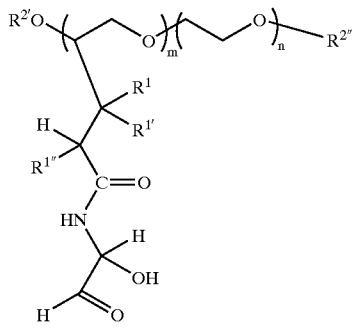

wherein $R^1$, $R^{1'}$ and $R^{1''}$ are independently H or a $C_1$ to $C_4$ alkyl group;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof; and m and n are integers such that m+n is greater than or equal to 350.

17. A paper product as defined in claim 1, wherein the fibrous web does not contain an epichlorohydrin derived wet strength resin.

18. A paper product as defined in claim 1, wherein the fibrous web further comprises a debonder.

19. A paper product comprising:

a fibrous web comprising cellulosic fibers, the web having a bulk density of at least 2 cc/g, said fibrous web being treated with a strength agent comprising a derivatized polyethylene oxide, the strength agent being present in the web in an amount sufficient to increase the tensile strength of the fibrous web, the derivatized polyethylene oxide comprising:

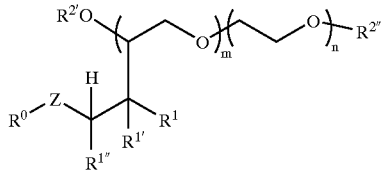

wherein $R^1$, $R^{1'}$, $R^{1''}$ are independently H or a $C_{1-4}$ alkyl;

Z is any bridging radical whose purpose is to incorporate the $R^0$ moiety into the ethylenically unsaturated monomer;

$R^0$ is any group capable of or containing a constituent capable of forming covalent, ionic and/or hydrogen bonds with cellulose or with the polymer itself;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof;

p is an integer greater than or equal to about 350; and m and n are integers such that m+n=p.

20. A paper product of claim 19, wherein Z is selected from the group comprising —O—, —S—, —OOC—, —COO—, —NHCO—, —CONH and mixtures thereof and $R^0$ is selected from the group comprising hydrogen, amine, amide, carboxyl, hydroxyl, aldehyde, epoxy, silanol, azetidinium and mixtures thereof.

21. A paper product as defined in claim 20, wherein the silanol derivatized polyethylene oxide comprises:

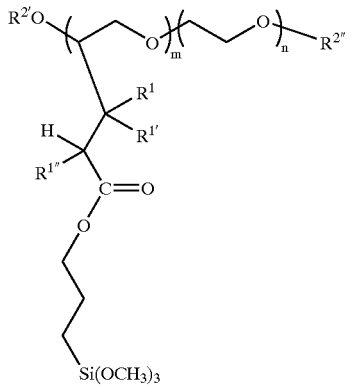

wherein $R^1$, $R^{1'}$, $R^{1''}$ are independently H or a $C_{1-4}$ alkyl;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof; and m and n are integers such that m+n is greater than or equal to 350.

22. A paper product of claim 19 having a static coefficient of friction in the wet state no more than 10% greater than the static coefficient of friction in the dry state.

23. A paper product of claim 19 having a kinetic coefficient of friction in the wet state no more than 20% greater than the kinetic coefficient of friction in the wet state.

24. A paper product as defined in claim 19, wherein the derivatized polyethylene oxide comprises a silanol derivatized polyethylene oxide.

25. A paper product as defined in claim 19, wherein the polyethylene oxide contained in the derivatized polyethylene oxide has a molecular weight of at least 20,000.

26. A paper product as defined in claim 19, wherein the polyethylene oxide contained in the derivatized polyethylene oxide has a molecular weight of at least 100,000.

27. A paper product as defined in claim 19, wherein the derivatized polyethylene oxide comprises a polyethylene oxide that has been grafted with an acrylamide or a methacrylamide followed by glyoxylation.

28. The paper product as defined in claim 27, wherein the derivatized polyethylene oxide comprises:

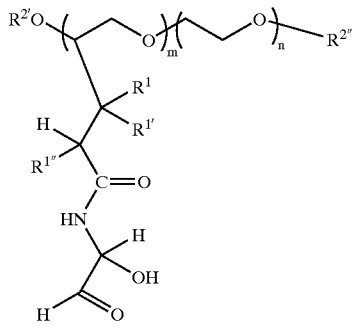

wherein $R^1$, $R^{1'}$ and $R^{1''}$ are independently H or a $C_1$ to $C_4$ alkyl group;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof; and m and n are integers such that m+n is greater than or equal to 350.

29. A paper product as defined in claim 19, wherein the paper product comprises a facial tissue, a bath tissue, or a paper towel.

30. A paper product as defined in claim 19, wherein the derivatized polyethylene oxide contains derivative groups in an amount from about 0.5% to about 25% by weight.

31. A paper product as defined in claim 19, wherein the derivatized polyethylene oxide is present in the fibrous web in an amount from about 0.05% to about 10% by weight of fibers contained in the fibrous web.

32. A paper product as defined in claim 19, wherein the derivatized polyethylene oxide is cationic.

33. A paper product as defined in claim 19, wherein the fibrous web does not contain an epichlorohydrin resin.

34. A paper product as defined in claim 19, wherein the fibrous web further comprises a debonder.

35. A process for improving the strength properties of a paper product comprising:

providing a fibrous web containing pulp fiber, the fibrous web having a bulk density of at least 2 cc/g; and treating the fibrous web with a derivatized polyethylene oxide, the derivatized polyethylene oxide being present in an amount sufficient to increase the tensile strength of the fibrous web, wherein the derivatized polyethylene oxide comprises:

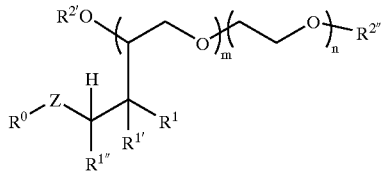

wherein $R^1$, $R^{1'}$, $R^{1''}$ are independently H or a $C_{1-4}$ alkyl;

Z is any bridging radical whose purpose is to incorporate the $R^0$ moiety into the ethylenically unsaturated monomer;

$R^0$ is any group capable of or containing a constituent capable of forming covalent, ionic and/or hydrogen bonds with cellulose or with the polymer itself;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof;

p is an integer greater than or equal to about 350; and m and n are integers such that m+n=p.

36. The paper product of claim 35, wherein Z is selected from the group comprising —O—, —S—, —OOC—, —COO—, —NHCO—, —CONH and mixtures thereof and $R^0$ is selected from the group comprising hydrogen, amine, amide, carboxyl, hydroxyl, aldehyde, epoxy, silanol, azetidinium and mixtures thereof.

37. A process as defined in claim 35, wherein the derivatized polyethylene oxide comprises a silanol derivatized polyethylene oxide.

38. A process as defined in claim 35, wherein the derivatized polyethylene oxide comprises:

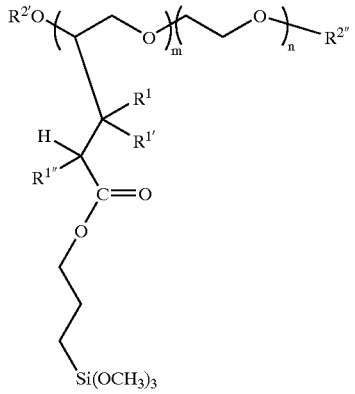

wherein $R^1$, $R^{1'}$, $R^{1''}$ are independently H or a $C_{1-4}$ alkyl;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof; and m and n are integers such that m+n is greater than or equal to 350.

39. A process as defined in claim 35, wherein the derivatized polyethylene oxide comprises a glyoxylated derivatized polyethylene oxide.

40. A process as defined in claim 39, wherein the derivatized polyethylene oxide comprises:

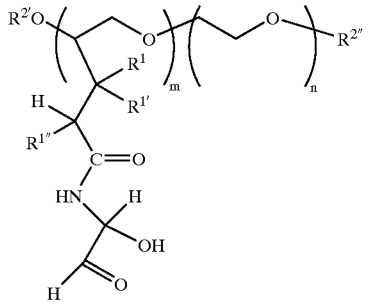

wherein $R^1$, $R^{1'}$ and $R^{1''}$ are independently H or a $C_1$ to $C_4$ alkyl group;

$R^{2'}$ and $R^{2''}$ are any suitable polyoxyethylene endgroups selected from the group of H, alkyl, aryl, alkyl esters, alkyl amides, sulfonates, substituted derivatives and mixtures thereof; and m and n are integers such that m+n is greater than or equal to 350.

41. A paper product as defined in claim 35, wherein the derivatized polyethylene oxide comprises a polyethylene oxide that has been grafted with an acrylamide or a methacrylamide followed by glyoxylation.

42. A process as defined in claim 35, wherein the derivatized polyethylene oxide is present in the fibrous web in an amount from about 0.5% to about 10% by weight of fibers present in the web.

43. A process as defined in claim 35, wherein the fibrous web is treated with the derivatized polyethylene oxide by combining an aqueous slurry containing the pulp fibers with the derivatized polyethylene oxide and then forming the aqueous slurry of fibers into the fibrous web.

44. A process as defined in claim 35, wherein the fibrous web is treated with the derivatized polyethylene oxide by topically applying the derivatized polyethylene oxide to the web.

45. A process as defined in claim 35, wherein the fibrous web is treated with the derivatized polyethylene oxide without applying any epichlorohydrin resins.

* * * * *